US008087390B2

(12) United States Patent
Hiyoshi et al.

(10) Patent No.: US 8,087,390 B2
(45) Date of Patent: Jan. 3, 2012

(54) MULTI-LINK VARIABLE COMPRESSION RATIO ENGINE

(75) Inventors: Ryosuke Hiyoshi, Yokosuka (JP); Yoshiaki Tanaka, Fujisawa (JP); Shinichi Takemura, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 639 days.

(21) Appl. No.: 12/255,751

(22) Filed: Oct. 22, 2008

(65) Prior Publication Data

US 2009/0107454 A1 Apr. 30, 2009

(30) Foreign Application Priority Data

Oct. 29, 2007 (JP) ..... 2007-280370

(51) Int. Cl.
*F02B 75/04* (2006.01)

(52) U.S. Cl. ..... 123/78 F; 123/48 A; 123/48 R; 123/78 B; 123/78 R

(58) Field of Classification Search ..... 123/48 R, 123/48 B, 78 B, 48 BA, 78 E, 78 F, 21
See application file for complete search history.

(56) References Cited

U.S. PATENT DOCUMENTS

| | | | | |
|---|---|---|---|---|
| 6,260,532 | B1 * | 7/2001 | Mendler | 123/192.2 |
| 6,390,035 | B2 | 5/2002 | Moteki et al. | |
| 7,363,902 | B2 | 4/2008 | Ushijima et al. | |
| 2001/0017112 | A1 * | 8/2001 | Moteki et al. | 123/78 R |
| 2001/0047778 | A1 * | 12/2001 | Aoyama et al. | 123/78 R |
| 2002/0002957 | A1 * | 1/2002 | Moteki et al. | 123/48 B |
| 2002/0050252 | A1 * | 5/2002 | Moteki | 123/48 B |
| 2005/0268870 | A1 * | 12/2005 | Hotta et al. | 123/78 F |

FOREIGN PATENT DOCUMENTS

| | | |
|---|---|---|
| JP | 2001-227367 A | 8/2001 |
| JP | 2002-061501 A | 2/2002 |
| JP | 2005-147068 A | 6/2005 |
| JP | 2005-163740 A | 6/2005 |
| JP | 2006-183595 A | 7/2006 |

* cited by examiner

*Primary Examiner* — Michael Cuff
*Assistant Examiner* — Long T Tran
(74) *Attorney, Agent, or Firm* — Global IP Counselors, LLP

(57) ABSTRACT

A multi-link variable compression ratio engine is provided with a crankshaft, a piston, a control shaft, a linkage, a motor and a reduction mechanism. The crankshaft moves the piston within an engine cylinder. The control shaft has an eccentric axle eccentric relative to its center-axis. The linkage operatively connects the piston to the crankshaft and the crankshaft to the eccentric axle of the control shaft. The motor rotates the control shaft so a top-dead-center position of the piston changes to vary compression ratios by changing the positions of the eccentric axle and the linkage. The reduction mechanism couples the motor to the control shaft to transmit a reduced rotation of the motor to the control shaft so a reduction ratio of a rotation angle of the motor to a rotation angle of the control shaft is less at high-compression ratios than at intermediate compression ratios.

8 Claims, 6 Drawing Sheets

MULTI-LINK VARIABLE COMPRESSION RATIO ENGINE

CROSS-REFERENCE TO RELATED APPLICATIONS

This application claims priority to Japanese Patent Application No. 2007-280370, filed on Oct. 29, 2007. The entire disclosure of Japanese Patent Application No. 2007-280370 is hereby incorporated herein by reference.

BACKGROUND OF THE INVENTION

1. Field of the Invention

The present invention generally relates to a multi-link variable compression ratio engine. More specifically, the present invention relates to a variable compression ratio mechanism of an engine which uses, non-exclusively, a control shaft, multiple links, a drive motor, and a reduction mechanism to change a top dead center position of a piston.

2. Background Information

A known example of a variable compression ratio mechanism of an engine is one in which a piston and a crank are connected via a plurality of links. For example, in Japanese Laid-Open Patent Application No. 2005-163740, the piston and the crank are connected via an upper link and a lower link, and the compression ratio is variably controlled by controlling the orientation of the lower link. Specifically, the mechanism comprises a control link connected to an eccentric axle provided to a control shaft that is connected at one end to the lower link and extends substantially parallel to the crankshaft at the other end. The orientation of the lower link is controlled via the control link by varying the angle of rotation of the control shaft.

The angle of rotation of the control shaft is controlled by a shaft control mechanism comprising a fork provided integrally to the control shaft, an actuator rod connected to the fork via a connecting pin, and a drive motor for causing the actuator rod to advance and retract in a direction orthogonal to the control shaft.

However, a connection mechanism using a fork (hereinafter referred to as "fork-type connection mechanism") such as in Japanese Laid-Open Patent Application No. 2005-163740 is configured so that the fork oscillates with bilateral symmetry in relation to the rotational axis of the control shaft, and the reduction ratio between the drive motor and the control shaft varies according to the advanced or retracted position of the actuator rod. In this case, since the reduction ratio is large at a high compression ratio, the control shaft loses responsiveness when the compression ratio is changed from a high compression ratio to an intermediate compression ratio. Therefore, when a sudden acceleration is made from a state having a high compression ratio (for example, a low rotational speed or a low-load operating area), the compression ratio cannot be rapidly changed from the high compression ratio to an intermediate compression ratio, and the problem of more frequent knocking occurs.

In view of the above, it will be apparent to those skilled in the art from this disclosure that there exists a need for an improved multi-link variable compression ratio engine. This invention addresses this need in the art as well as other needs which will become apparent to those skilled in the art from this disclosure.

SUMMARY OF THE INVENTION

It has been discovered that in a conventional multi-link variable compression ratio engine, more frequent knocking occurs due to a slow change from a high compression ratio to an intermediate compression ratio.

In view of the problems described above, one object is to provide a multi-link variable compression ratio engine in which it is possible to suppress the occurrence of knocking caused by changes in the compression ratio.

In accordance with a first aspect, a multi-link variable compression ratio engine is provided that comprises a crankshaft, a piston, a control shaft, linkage, a drive motor, and a reduction mechanism. The piston is operatively coupled to the crankshaft to move back and forth within a cylinder of the engine. The control shaft is rotatably supported on the engine. The control shaft also has an eccentric axle that is eccentric relative to a rotational center axis of the control shaft. The linkage operatively connects the piston to the crankshaft and the crankshaft to the eccentric axle of the control shaft. The drive motor is operatively coupled to the control shaft to rotate the control shaft about the rotational center axis. This rotation causes a top dead center position of the piston to change by turning the control shaft. Turning the control shaft varies a compression ratio of the engine by changing the position of the eccentric axle and the orientation of the linkage. The reduction mechanism couples the drive motor to the control shaft to reduce the rotation of the drive motor and transmit the rotation to the control shaft. This transmitting of rotation causes a reduction ratio of a rotation angle of the drive motor to a rotation angle of the control shaft to be less at a high compression ratio than at an intermediate compression ratio.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents. Numerical symbols corresponding to the embodiments of the present invention are used for the sake of easier comprehension, but these numerical symbols do not limit the present invention.

Figure 1:
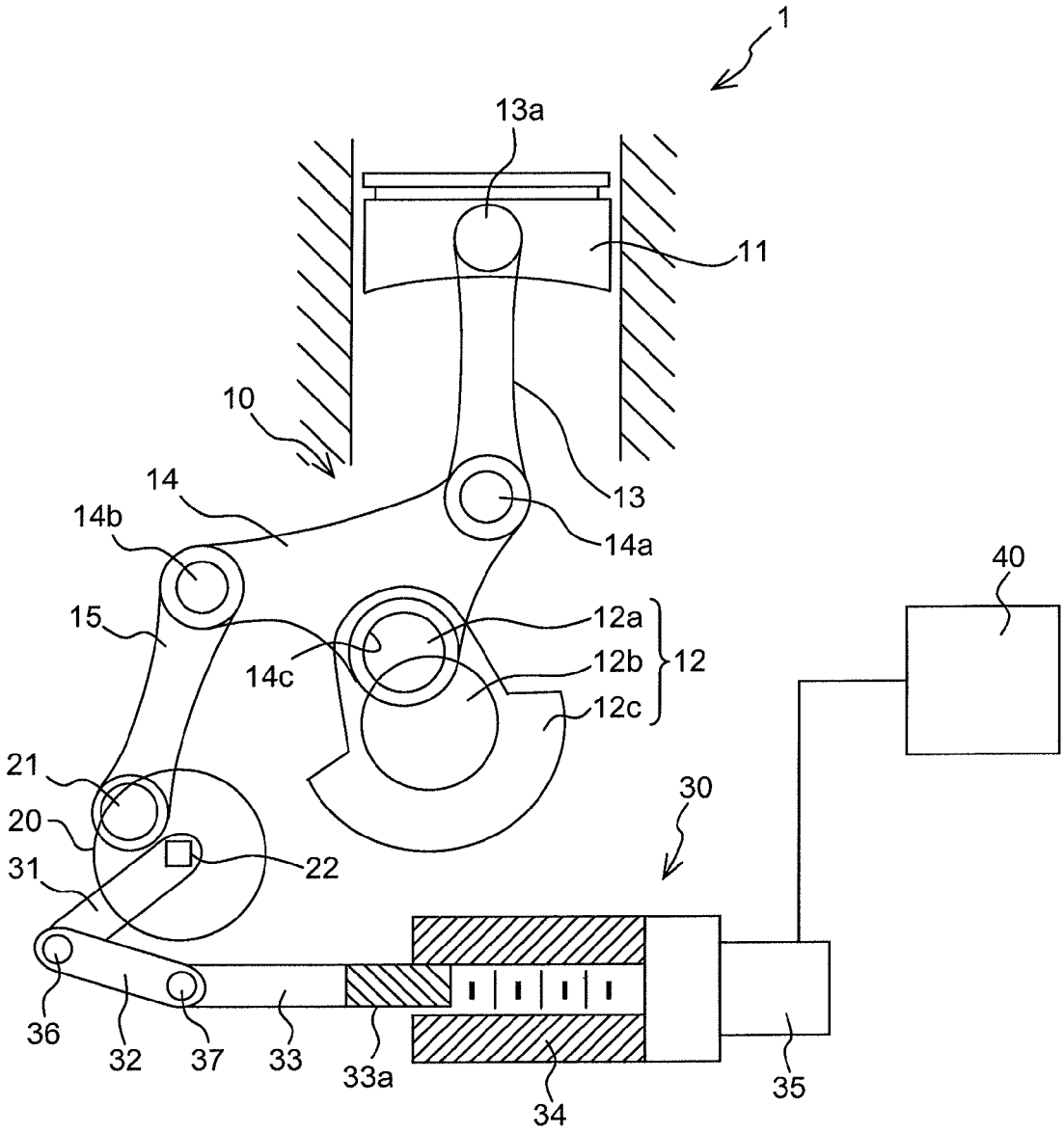
FIG. 1 is a block diagram showing the operational configuration of the multilink variable compression ratio engine in accordance with one embodiment.

Referring initially to FIG. 1, a multilink variable compression ratio engine 1 as seen from the direction of the crankshaft is illustrated in accordance with a first embodiment of the present invention. The multi-link variable compression ratio engine 1 includes, among other things, a compression ratio varying mechanism 10, a piston 11 and a crankshaft 12. The compression ratio varying mechanism 10 is arranged to vary the top dead center position of the piston 11 in order to vary the compression ratio. The compression ratio varying mechanism 10 includes an upper link 13, a lower link 14 and the control link 15. The piston 11 and the crankshaft 12 are interconnected by the upper link 13 and the lower link 14. The compression ratio of the engine 1 is varied by controlling the orientation of the lower link 14 with the aid of the control link 15. The upper link 13, the lower link 14 and the control link 15 together can be considered a linkage.

The upper link 13 is connected to the piston 11 at the top end via a piston pin 13*a*. The bottom end of the upper link 13 is connected to one end of the lower link 14 via an upper pin 14*a*. The other end of the lower link 14 is connected to the control link 15 via a control pin 14*b*. The lower link 14 has a connecting hole 14*c*, and a crank pin 12*a* of the crankshaft 12 is inserted through the connecting hole 14*c*. The lower link 14 oscillates around the crank pin 12*a* which serves as a center axis for the lower link 14.

The crankshaft 12 comprises the crank pin 12*a*, a journal 12*b*, and a counterweight 12*c*. The center of the crank pin 12*a* is eccentric relative to the center of the journal 12*b* by a predetermined amount. The counterweight 12*c* is formed integrally with a crank arm connecting the journal 12*b* to the crank pin 12*a*, reducing the rotational first-order vibration component of the piston movement.

The top end of the control link 15 is rotatably connected to the lower link 14 via the control pin 14*b*. The bottom end of the control link 15 is connected to a control shaft 20.

The control shaft 20 is disposed substantially parallel to the crankshaft 12, and is supported in a rotatable manner on the engine body. The control shaft 20 comprises an eccentric axle 21 and a shaft-controlling axle 22.

The eccentric axle 21 is eccentric relative to the rotational axis of the control shaft 20 by a predetermined amount. The control link 15 oscillates in relation to the eccentric axle 21.

The shaft-controlling axle 22 is provided so that the center of the axle coincides with the rotational axis of the control shaft 20. A connecting link 31 of a shaft control mechanism 30 is fixed to the shaft-controlling axle 22, and the connecting link 31 thereby turns integrally with the control shaft 20. In the present embodiment, the connecting link 31 is a separate structure assembled on the control shaft 20, but the link can also be formed integrally with the control shaft 20 as a one-piece, unitary member. In other words, the control shaft 20 can be understood to include the connecting link 31 of the shaft control mechanism 30 as well.

The shaft control mechanism 30 comprises the connecting link 31, an intermediate control link 32, an actuator rod 33, a ball screw nut 34 and a drive motor 35. The shaft control mechanism 30 controls the angle of rotation of the control shaft 20.

One end of the connecting link 31 is fixed to the shaft-controlling axle 22 so as to rotate integrally with the control shaft 20. The other end of the connecting link 31 is rotatably connected to one end of the intermediate control link 32 via a connecting pin 36. The other end of the intermediate control link 32 is rotatably connected to one end of the actuator rod 33 via a connecting pin 37.

The actuator rod 33 has, in the outer periphery of the proximal end side (the right side in the drawing), a ball screw part 33*a* in which a male thread is formed. The ball screw part 33 a is screwed into a female thread formed in the interior of the ball screw nut 34. The actuator rod 33 is provided to the ball screw nut 34 in a manner that allows the actuator rod to advance and retract. When the ball screw nut 34 is rotatably driven around an axis by the drive motor 35, the actuator rod 33 moves back and forth relative to the ball screw nut 34.

The drive motor 35 has a mechanism (hereinafter referred to as "holding mechanism") for switching between permitting and halting the rotation of the control shaft 20 to hold the control shaft 20 at a predetermined angle of rotation. The combustion pressure in the cylinder, the inertial force of the piston 11, and the like are transmitted to the control shaft 20 via the upper link 13, the lower link 14, and the control link 15. These transmitted loads act as torque for turning the control shaft 20 (hereinafter referred to as "control shaft torque"), because the eccentric axle 21 is eccentric relative to the rotational axis of the control shaft 20. The drive motor 35 holds the control shaft 20 at a predetermined angle of rotation against the control shaft torque due to the flow of an electric current in the opposite direction from the control shaft torque during driving.

The variable compression ratio engine 1 has a controller 40 configured to vary the compression ratio in accordance with the operating state of the engine. The controller 40 has a CPU, ROM, RAM and an I/O interface. The controller 40 controls the driving of the drive motor 35 of the shaft control mechanism 30 in order to vary the compression ratio in accordance with the operating state of the engine.

In the variable compression ratio engine 1 configured as described above, the driving of the drive motor 35 is controlled by the controller 40, and the actuator rod 33 is made to advance and retract linearly in accordance with the operating state of the engine, whereby the angle of rotation of the control shaft 20 is controlled and the compression ratio is varied.

The control shaft 20 turns counterclockwise in the drawing via the intermediate control link 32 and the connecting link 31 around the shaft-controlling axle 22 as a rotational axis when the actuator rod 33 of the shaft control mechanism 30 retracts toward the right side of the drawing in FIG. 1. The position of the eccentric axle 21 to which the control link 15 is connected is thereupon lowered. When the eccentric axle 21 is thus lowered, the lower link 14 tilts counterclockwise in the drawing around the crank pin 12*a*, raising the position of the upper pin 14*a*, and the top dead center position of the piston 11 therefore rises, increasing the compression ratio.

The control shaft 20 turns clockwise in the drawing via the intermediate control link 32 and the connecting link 31 around the shaft-controlling axle 22 as a rotational axis when the actuator rod 33 advances to the left in the drawing. The position of the eccentric axle 21 thereupon rises, the lower link 14 tilts, and the position of the upper pin 14*a* is lowered, causing the top dead center position of the piston 11 to be lowered, decreasing the compression ratio.

Thus, in the variable compression ratio engine 1, the compression ratio is optimally controlled according to the operating state, e.g., the compression ratio can be increased to improve combustion efficiency (reducing exhaust loss by increasing the expansion ratio) at a low rotational speed or in a low-load operating area, and the compression ratio can be decreased to prevent knocking at a high rotational speed or in a high-load operating area.

In the shaft control mechanism 30 described above, the rotation of the drive motor 35 causes the control shaft 20 to be turned by the back-and-forth movement of the actuator rod 33 accompanying the relative rotation between the ball screw nut 34 and the ball screw part 33*a*, and then by the resulting movement of the intermediate control link 32 and the connecting link 31. The rotational speed of the drive motor 35 is reduced by the arrangement of these links (hereinafter referred to as the "link geometry") and is converted to rotation of the control shaft 20. The link geometry changes and the control shaft 20 turns when there is a change in the advanced or retracted position of the actuator rod 33.

The reduction ratio between the drive motor 35 and the control shaft 20 is equal to the angle of rotation of the drive motor 35 divided by the angle of rotation of the control shaft 20. The reduction ratio changes when there is such a change in the link geometry. Thus, a reduction mechanism is configured from the connecting link 31, the intermediate control link 32, the actuator rod 33, and the ball screw nut 34 in the shaft control mechanism 30.

Figure 2A:
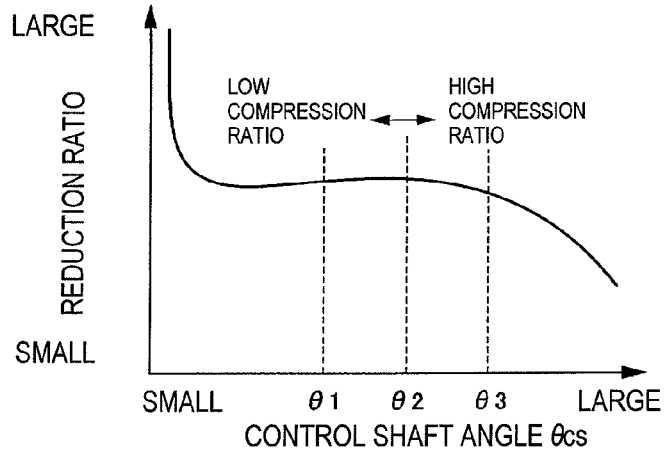
FIG. 2A is a graph showing the relationship between the reduction ratio and the control shaft angle which depends on the link geometry.

FIG. 2A is a graph showing the relationship between the reduction ratio and the control shaft angle which depends on the link geometry. The horizontal axis represents the angle of rotation θcs of the control shaft 20 (hereinafter referred to as the "control shaft angle"). The vertical axis represents the relationship in reduction ratios between the drive motor and the control shaft. The control shaft angle θcs is the angle of rotation from a predetermined position, and the angle is positive when the control shaft 20 turns counterclockwise in FIG. 1.

The reduction ratio changes as shown in FIG. 2A when there is a change in the link geometry which causes the control shaft 20 to turn. Particularly, the reduction ratio increases from θ1 to θ2, and the reduction ratio decreases from θ2 to θ3 when the control shaft angle θcs is in a range from θ1 to θ3. In the present embodiment, when the reduction ratio is in the upwardly convex range of θ1 to θ3, the control shaft angle θcs is varied to control the compression ratio of the variable compression ratio engine 1. Specifically, the settings are designed so that when the control shaft angle θcs is θ1, the compression ratio is at the minimum level, and when the control shaft angle θcs is θ3, the compression ratio is at the maximum level.

Figure 2B:
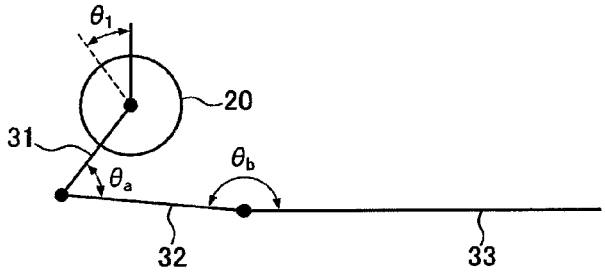
FIG. 2B is a diagram showing the angles of the link geometry at the minimum compression ratio.
Figure 2C:
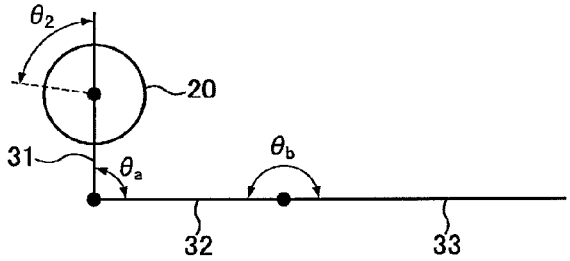
FIG. 2C is a diagram showing the angles of the link geometry at the intermediate compression ratio.
Figure 2D:
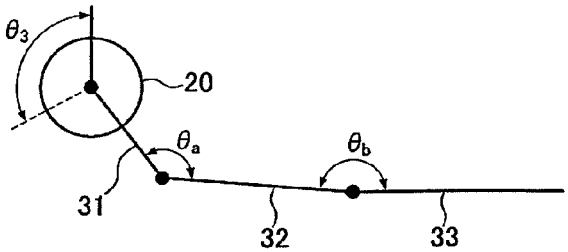
FIG. 2D is a diagram showing the angles of the link geometry at the maximum compression ratio.

FIGS. 2B through 2D are diagrams, as seen from the axial direction of the control shaft, showing the angles of the link geometry between the connecting link 31, the intermediate control link 32, and the actuator rod 33 when the control shaft angle θcs is at θ1, θ2, or θ3 at various compression ratios.

At the minimum compression ratio at which the control shaft angle θcs is θ1, the angle θa formed by the connecting link 31 and the intermediate control link 32 is less than 90°, and the angle θb formed by the intermediate control link 32 and the actuator rod 33 is less than 180°, as shown in FIG. 2B.

At the intermediate compression ratio at which the control shaft angle θcs is θ2, the angle θa formed by the connecting link 31 and the intermediate control link 32 is substantially 90°, and the angle θb formed by the intermediate control link 32 and the actuator rod 33 is substantially 180°, as shown in FIG. 2C.

At the maximum compression ratio at which the control shaft angle θcs is θ3, the angle θa formed by the connecting link 31 and the intermediate control link 32 is greater than 90°, and the angle θb formed by the intermediate control link 32 and the actuator rod 33 is less than 180°, as shown in FIG. 2D.

Figure 3:
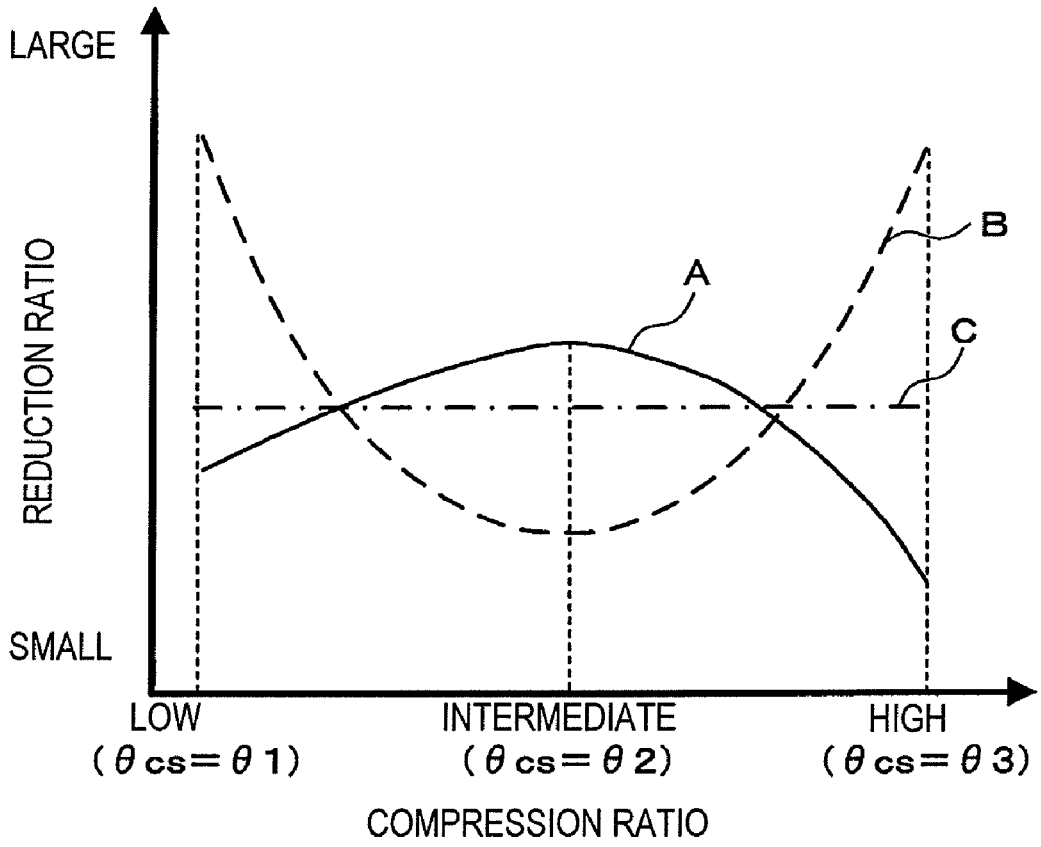
FIG. 3 is a diagram showing the relationship between the reduction ratio and the compression ratio depending on the type of connection mechanism between the drive motor and the control shaft.

The following is a description, made with reference to FIG. 3, of the relationship between the reduction ratio and the compression ratio depending on the type of connection mechanism between the drive motor 35 and the control shaft 20.

A fork-type connection mechanism based on a conventional method is configured so that the fork oscillates in bilateral symmetry in relation to the rotational axis of the control shaft 20, and the reduction ratio is greater at a low compression ratio and a high compression ratio than at an intermediate compression ratio, as shown by the dashed line B in FIG. 3. Therefore, in cases in which a sudden acceleration is made from a low rotational speed or a low-load operating area, which is a state having a high compression ratio, the compression ratio cannot be rapidly changed from a high compression ratio to an intermediate compression ratio, and a problem is encountered in which knocking readily occurs. Since the changes in the compression ratio are not very responsive at a low compression ratio, the compression ratio cannot be rapidly changed in accordance with the operating state of the engine, and the potential to improve fuel consumption performance by lowering the compression ratio is reduced.

In cases in which the control shaft 20 and the drive motor 35 are connected by a rack-and-pinion connection mechanism using a conventional method (hereinafter referred to as a "rack-and-pinion connection mechanism"), the reduction ratio between the drive motor 35 and the control shaft 20 is constant, as shown by the single-dotted line C in FIG. 3. In this rack-and-pinion connection mechanism, the reduction ratio at a low compression ratio or a high compression ratio can be kept lower than in a fork-type connection mechanism, but since the reduction ratio remains low even at an intermediate compression ratio in which the control shaft torque is at a maximum, a large torque is inputted to the drive motor 35 as a result of the control shaft torque, and a problem is encountered in which the load on the drive motor increases in order to resist this torque.

In the present embodiment, the reduction ratio is kept lower at a high compression ratio or a low compression ratio than at an intermediate compression ratio, as shown by the solid line A in FIG. 3, in order to resolve the problems described above. Therefore, the compression ratio can be rapidly changed from a high compression ratio or a low compression ratio because the rotation is transmitted to the control shaft 20 without reducing much of the rotational speed of the drive motor 35.

Therefore, occurrences of knocking can be reduced because the compression ratio can be rapidly changed from a high compression ratio to an intermediate compression ratio even in cases in which the vehicle suddenly accelerates from a low rotational speed or a low-load operating area, which is a state having a high compression ratio. Since the compression ratio can be rapidly changed in accordance with the operating state of the engine even at a low compression ratio, the effects of improving fuel consumption performance by lowering the compression ratio are greater.

Since the reduction ratio is also greater at an intermediate compression ratio than at a high compression ratio or a low compression ratio, the amount of drive torque Tm needed for the drive motor 35 to rotate the control shaft 20 during changes to the compression ratio can be reduced. The drive torque Tm of the drive motor 35 is calculated using the following formula (1).

$$Tm = W/N \quad (1),$$

where Tm[Nm]: drive torque of drive motor,

W[J]: workload of drive motor, and

N[rpm]: rotational speed of the drive motor when the control shaft is turned by a unit angle.

Since the reduction ratio between the drive motor 35 and the control shaft 20 is high at an intermediate compression ratio, an increase is seen in the rotational speed N of the drive motor when the control shaft 20 is turned by a unit angle. Therefore, in cases in which the motor workload W is constant regardless of the compression ratio of the variable compression ratio engine 1, the drive torque Tm of the drive motor 35 is smallest at an intermediate compression ratio at which the reduction ratio is large. The actual motor workload W varies according to the compression ratio, but it is nevertheless possible, as described above, for the reduction ratio at an intermediate compression ratio to be kept high in the present embodiment even in cases in which the motor workload W is brought to a maximum at an intermediate compression ratio by the pressure in the cylinder, the arrangement of links in the compression ratio varying mechanism 10, and other factors. It is therefore possible to suppress increases in the drive torque Tm of the drive motor 35 and increases in the load of the drive motor 35 when the compression ratio is varied at an intermediate level.

Since the shaft control mechanism 30 has the link geometry such as is shown in FIG. 2C at an intermediate compression ratio at which the reduction ratio is large, it is possible to reduce the bending load produced in the actuator rod 33 by the control shaft torque, and to suppress increases in the load of the drive motor 35 when the control shaft 20 is held against the control shaft torque.

Figure 4A:
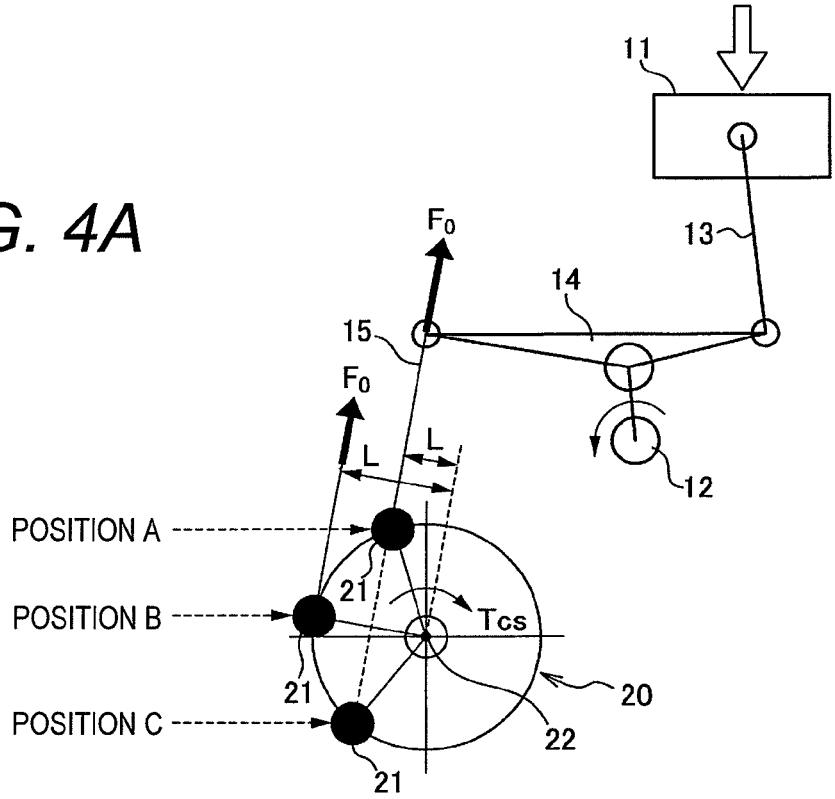
FIG. 4A is a diagram showing the relationship between the control shaft torque and the link geometry at various compression ratios.
Figure 4B:
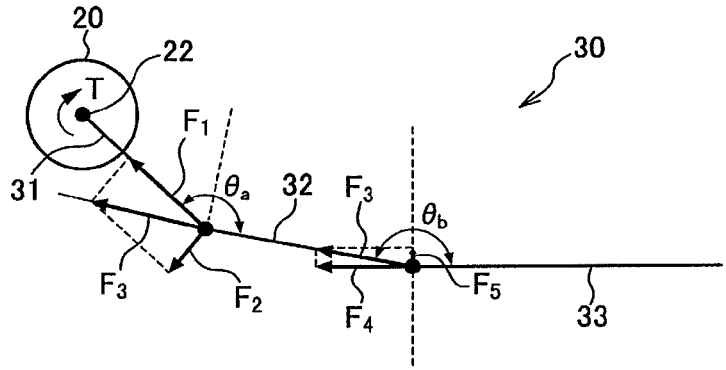
FIG. 4B is a diagram showing the relationship between the control shaft torque and the angles of the link geometry in accordance with a comparative example of a conventional structure.
Figure 4C:
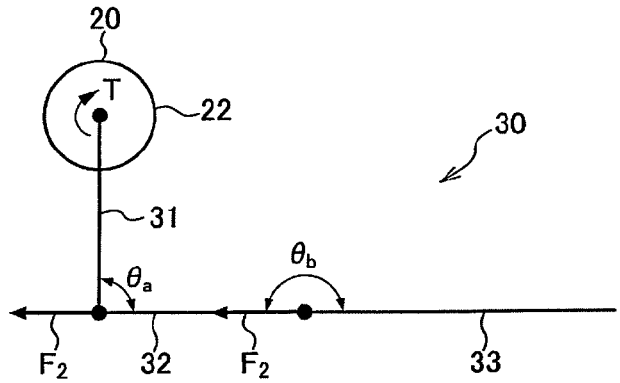
FIG. 4C is a diagram showing the relationship between the control shaft torque and the angles of the link geometry in accordance with the illustrated embodiment.

FIG. 4A-4C show the relationship between the control shaft torque and the link geometry at various compression ratios and display the effects of reducing the bending load occurring in the actuator rod 33.

FIG. 4A is a diagram that illustrates this relationship. In the present embodiment, the compression ratio is at a minimum when the eccentric axle 21 of the control shaft 20 is in a position A, and the compression ratio is at a maximum when the eccentric axle 21 is in a position C, as shown in FIG. 4A. The compression ratio is intermediate when the eccentric axle 21 is in a position B. Therefore, as the compression ratio changes from the lowest level (position A) toward an intermediate level (position B), there is an increase in the effective arm length L over which the load F0 transmitted from the control link 15 is converted to the control shaft torque Tcs about the shaft-controlling axle 22. The effective arm length L decreases as the compression ratio changes from the intermediate level (position B) toward a maximum level (position C). Therefore, the control shaft torque Tcs is greatest at an intermediate compression ratio at which the effective arm length L is at a maximum.

A conventional case will now be considered in which the link geometry of the shaft control mechanism 30 at an intermediate compression ratio is set so that the angle θa formed by the connecting link 31 and the intermediate control link 32 is greater than 90°, and the angle θb formed by the intermediate control link 32 and the actuator rod 33 is less than 180°, as shown in FIG. 4B. In this case, the control shaft torque Tcs causes the connecting link 31 to be subjected to a load F1 in the axial direction of the connecting link 31 and a load F2 in a direction orthogonal to the connecting link 31. The load F1 and the load F2 cause a tensile load F3 to act on the intermediate control link 32 in the axial direction of the intermediate control link 32. The actuator rod 33 is thereupon subjected to the tensile load F3 from the intermediate control link 32, and a tensile load F4 acts in the axial direction of the actuator rod 33 while a bending load F5 acts in a direction orthogonal (upward in the diagram) to the axial direction of the actuator rod 33. A bending load F5 on the actuator rod 33 also increases at an intermediate compression ratio at which the control shaft torque Tcs is at a maximum, and friction between the actuator rod 33 and the ball screw nut 34 therefore becomes extremely large. Accordingly, when the control shaft 20 is held, the load of the drive motor 35 increases with the loads on the link geometry of the shaft control mechanism 30 such as the one shown in FIG. 4B.

In the present embodiment, since the angle θa formed by the connecting link 31 and the intermediate control link 32 is substantially 90° at an intermediate compression ratio at which the control shaft torque Tcs is at a maximum, the control shaft torque Tcs causes a tensile load F2 to act on the intermediate control link 32 in the axial direction of the intermediate control link 32, as shown in FIG. 4C. Since the angle θb formed by the intermediate control link 32 and the actuator rod 33 is substantially 180°, the tensile load F2 acts unchanged on the actuator rod 33 as well. Thus, in the present embodiment, the load produced on the actuator rod 33 by the control shaft torque Tcs at an intermediate compression ratio acts only in the axial direction of the actuator rod 33. Therefore, a bending load does not occur on the actuator rod 33 even at an intermediate compression ratio at which the control shaft torque Tcs is at a maximum. Thus, as the angle between the intermediate control link 32 and the actuator rod 33 approaches 180°, the bending load acting on the actuator rod 33 is reduced.

With this multi-link variable compression ratio engine, since the reduction ratio at a high compression ratio is kept lower than at an intermediate compression ratio, the compression ratio can be rapidly changed from a high compression ratio to an intermediate compression ratio even in cases in which the vehicle suddenly accelerates from a low rotational speed or a low-load operating area, which is a state having a high compression ratio. The occurrence of knocking can thereby be reduced.

In the present embodiment, since the reduction ratio at a low compression ratio is kept below that at an intermediate compression ratio, the compression ratio can be rapidly changed in accordance with the operating state of the engine even at a low compression ratio, and the effects of improving fuel consumption performance by lowering the compression ratio are greater.

Furthermore, since the reduction ratio is greater at an intermediate compression ratio than at a high compression ratio or a low compression ratio, the drive torque Tm needed for the drive motor 35 to rotate the control shaft 20 during changes to the compression ratio can be reduced. Therefore, increases in the load of the drive motor 35 can be reduced when the compression ratio is changed to an intermediate level.

Furthermore, since the link geometry of the shaft control mechanism 30 at an intermediate compression ratio is such that the intermediate control link 32 and the actuator rod 33 are nearly parallel, the bending load acting on the actuator rod 33 can be reduced. Therefore, when the control shaft 20 is held against the control shaft torque Tcs, the increased load of the drive motor 35 can be suppressed even at an intermediate compression ratio at which the control shaft torque Tcs is at a maximum.

Second Embodiment

Figure 5:
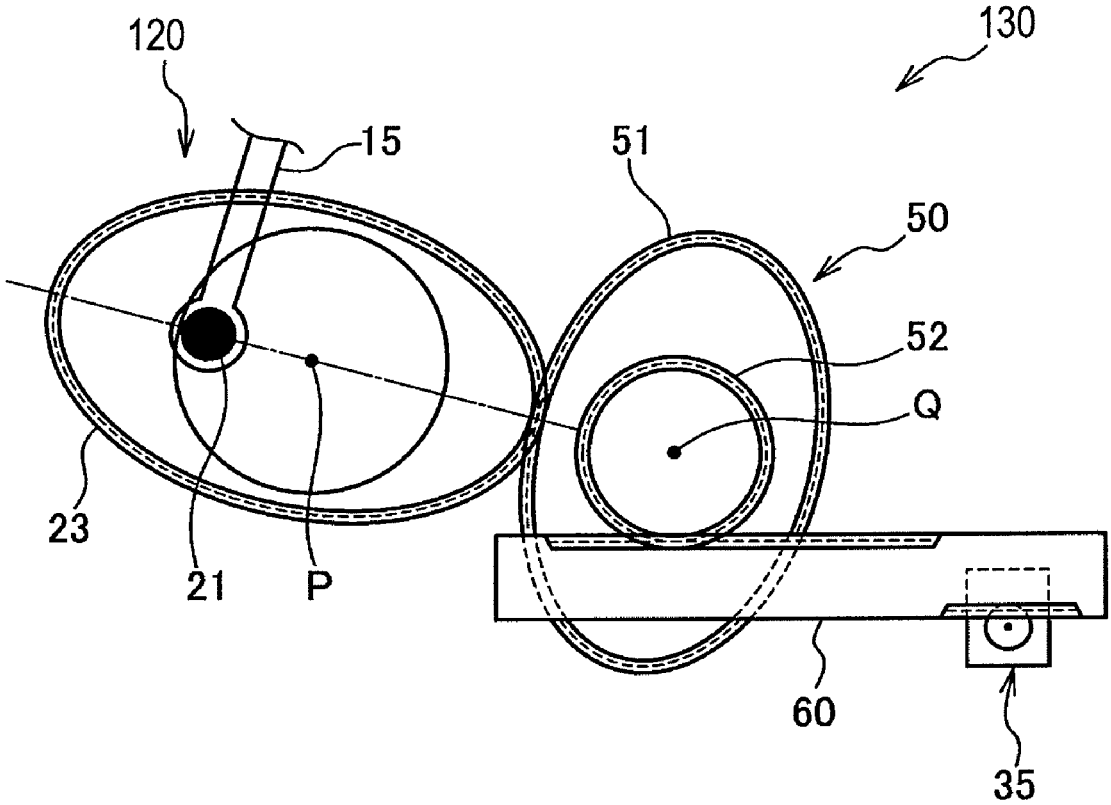
FIG. 5 is a drawing showing the shaft control mechanism of a multilink variable compression ratio engine in accordance with a second embodiment.

Referring now to FIG. 5, a second embodiment of a reduction mechanism for the multi-link variable compression ratio engine 1 shown in FIG. 1 will now be explained. Basically, in this second embodiment, the control shaft 20 and the reduction mechanism 31-34 of the first embodiment are replaced in FIG. 1 with a modified structure as discussed below. In view of the similarity between the first and second embodiments, the descriptions of the parts of the second embodiment that are identical to the parts of the first embodiment may be omitted for the sake of brevity.

A shaft control mechanism 130 with a reduction mechanism for the multi-link variable compression ratio engine 1 shown in FIG. 1 will now be explained.

The essential configuration of the variable compression ratio engine 1 of the second embodiment is substantially the same as that of the first embodiment, but differs in the configuration of the shaft control mechanism 130. Namely, in the shaft control mechanism 130, the reduction mechanism is configured from an elliptically shaped shaft-side pinion gear 23 formed on the control shaft 120, and an elliptically shaped drive gear 50 meshed with the shaft-side pinion gear 23. These differences will primarily be described below.

The shaft control mechanism 130 comprises the control shaft 120, a drive gear 50, and a rack gear 60 as shown in FIG. 5. The control shaft 120 has an elliptically shaped shaft-side pinion gear 23. The shaft-side pinion gear 23 turns integrally with the control shaft 120, and turns around the axial center P of the control shaft 120. An eccentric axle 21 connected to a control link 15 is eccentric by a predetermined amount from the axial center P of the control shaft 120 so as to be positioned along the major axis of the shaft-side pinion gear 23, as seen from the axial direction of the control shaft.

The drive gear 50 has an elliptically shaped drive-side pinion gear 51 and a circularly shaped pinion gear 52. The drive-side pinion gear 51 meshes with the shaft-side pinion gear 23. The drive-side pinion gear 51 and the circular pinion gear 52 are formed so that their axial centers coincide with each other, and these two gears rotate around an axial center Q. The circular pinion gear 52 meshes with the rack gear 60.

The rack gear 60 in meshing engagement with the circular pinion gear 52 is shaped as a rod in the form of a flat plate, and is adapted to be advanced and retracted to the left and right of the drawing by the drive motor 35.

Figure 6A:
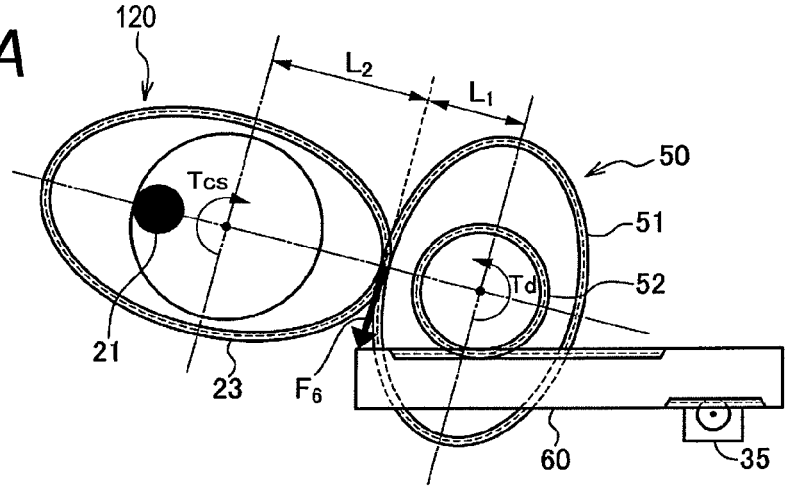
FIG. 6A is a drawing showing the arrangement of the shaft-side pinion gear and the drive-side pinion gear at an intermediate compression ratio.
Figure 6B:
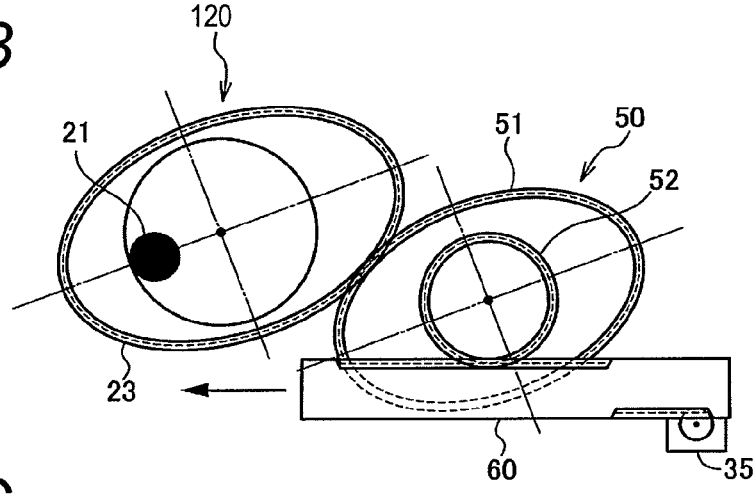
FIG. 6B is a drawing showing the arrangement of the shaft-side pinion gear and the drive-side pinion gear at a high compression ratio.

The shaft control mechanism 130 configured as described above controls the angle of rotation of the control shaft 120 and varies the compression ratio by linearly advancing and retracting the rack gear 60 in accordance with the operating state of the engine. The action of the shaft control mechanism 130 is described with reference to FIGS. 6A-6C. FIG. 6A shows the arrangement of the shaft-side pinion gear 23 and the drive-side pinion gear 51 at an intermediate compression ratio. FIG. 6B shows the arrangement of the shaft-side pinion gear 23 and the drive-side pinion gear 51 at a high compression ratio, and FIG. 6C shows the arrangement of the shaft-side pinion gear 23 and the drive-side pinion gear 51 at a low compression ratio.

At an intermediate compression ratio, the major axis of the shaft-side pinion gear 23 and the minor axis of the drive-side pinion gear 51 are arranged so as to coincide with each other, as shown in FIG. 6A. In the shaft control mechanism 130, the rotation of the drive motor 35 is transmitted to the control shaft 120 via the rack gear 60 and the drive gear 50, but since the minor axis of the drive-side pinion gear 51 and the major axis of the shaft-side pinion gear 23 are arranged so as to coincide with each other at an intermediate compression ratio, the rotational speed of the drive motor 35 is greatly reduced between the drive-side pinion gear 51 and the shaft-side pinion gear 23.

When the rack gear 60 advances to the left in the drawing, the circular pinion gear 52 turns clockwise in the drawing, as shown in FIG. 6B, and the drive-side pinion gear 51 therefore also turns clockwise in the drawing. The position of the eccentric axle 21 is thereupon lowered because the shaft-side pinion gear 23 turns counterclockwise in the drawing. The top dead center position of a piston (not shown) rises to increase the compression ratio when the eccentric axle 21 is lowered in this manner. Thus, in cases in which the compression ratio changes from an intermediate level to a high level, the position where the drive-side pinion gear 51 and the shaft-side pinion gear 23 mesh with each other changes from the minor axis side to the major axis side in the drive-side pinion gear 51, and from the major axis side to the minor axis side in the shaft-side pinion gear 23. Therefore, the reduction ratio between the drive motor 35 and the control shaft 120 is less than at an intermediate compression ratio.

Figure 6C:
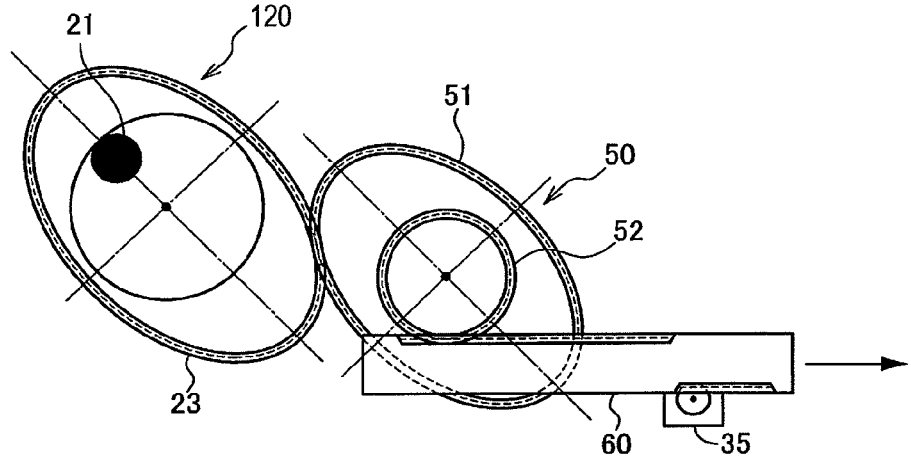
FIG. 6C is a drawing showing the arrangement of the shaft-side pinion gear and the drive-side pinion gear at a low compression ratio.

When the rack gear 60 retracts to the right of the drawing, the circular pinion gear 52 turns counterclockwise in the drawing, as shown in FIG. 6C, and the drive-side pinion gear 51 therefore also turns counterclockwise in the drawing. The position of the eccentric axle 21 thereupon rises because the shaft-side pinion gear 23 turns clockwise in the drawing. The top dead center of the piston (not shown) moves lower to decrease the compression ratio when the eccentric axle 21 rises in this manner. Thus, in cases in which the compression ratio changes from an intermediate level to a low level, the position where the drive-side pinion gear 51 and the shaft-side pinion gear 23 mesh with each other changes from the minor axis side to the major axis side in the drive-side pinion gear 51, and from the major axis side to the minor axis side in the shaft-side pinion gear 23. Therefore, the reduction ratio between the drive motor 35 and the control shaft 120 is less than at an intermediate compression ratio.

As described in FIG. 4A, the control shaft torque Tcs is greatest at an intermediate compression ratio at which the reduction ratio increases. In the present embodiment, however, the minor axis of the drive-side pinion gear 51 and the major axis of the shaft-side pinion gear 23 are arranged so as to coincide with each other, as shown in FIG. 6A. It is therefore possible to suppress increases in the torque Td produced in the drive gear 50 by the control shaft torque Tcs. Namely, the control shaft torque Tcs produces a load F6 in the position where the shaft-side pinion gear 23 and the drive-side pinion gear 51 mesh with each other, as shown by the thick arrow in FIG. 6A, but since the effective arm length L1 over which the load F6 is converted to a torque Td around the axis of the drive-side pinion gear 51 is less than the effective arm length L2 of the shaft-side pinion gear 23, the torque Td produced in the drive gear 50 is less than the control shaft torque Tcs.

As described above, the following effects can be achieved by the second embodiment. In the second embodiment, the minor axis of the drive-side pinion gear 51 is arranged so as to coincide with the major axis of the shaft-side pinion gear 23 at an intermediate compression ratio, whereby the reduction ratio at a high compression ratio can be kept less than that at an intermediate compression ratio, and the same effects as in the first embodiment can therefore be achieved.

It is possible to suppress increases in the torque Td produced in the drive gear 50 by the control shaft torque Tcs at an intermediate compression ratio. Therefore, increases in the load of the drive motor 35 can also be reduced when the control shaft 120 is held against the control shaft torque Tcs.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings, such as the terms "including," "having" and their derivatives. Also, the terms "part," "section," "portion," "member" or "element," when used in the singular, can have the dual meaning of a single part or a plurality of parts. Terms of degree such as "substantially," "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected to or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A multi-link variable compression ratio engine comprising:

a crankshaft;

a piston operatively coupled to the crankshaft to move back and forth within a cylinder of the engine;

a control shaft rotatably supported on the engine, the control shaft having an eccentric axle that is eccentric relative to a rotational center axis of the control shaft;

a linkage operatively connecting the piston to the crankshaft and the crankshaft to the eccentric axle of the control shaft;

a drive motor operatively coupled to the control shaft to rotate the control shaft about the rotational center axis such that a top dead center position of the piston is changed by turning the control shaft to vary a compression ratio of the engine by changing the position of the eccentric axle and the orientations of the linkage; and a reduction mechanism coupling the drive motor to the control shaft to reduce the rotation of the drive motor and transmit the rotation to the control shaft such that a reduction ratio of a rotation angle of the drive motor to a rotation angle of the control shaft is less at a high compression ratio than at an intermediate compression ratio.

2. The multi-link variable compression ratio engine of claim 1, wherein the reduction mechanism is configured such that the reduction ratio is less at a low compression ratio than at an intermediate compression ratio.

3. The multi-link variable compression ratio engine of claim 1, wherein the reduction mechanism includes an actuator rod which is rotatably connected to the linkage, and which is advanced and retracted by the drive motor in a direction orthogonal to the control shaft, and the drive motor advances and retracts the actuator rod in accordance with an operating state of the engine and turns the control shaft via the linkage to vary the compression ratio of the engine.

4. The multi-link variable compression ratio engine of claim 3, wherein the reduction mechanism further includes a threaded drive mechanism connecting the actuator rod to the drive motor by a screw structure to convert the rotational motion of the drive motor to the actuator rod for advancing and retracting the actuator rod.

5. The multi-link variable compression ratio engine of claim 1, wherein the reduction mechanism includes an elliptically shaped shaft-side pinion gear mounted on the control shaft to rotate integrally with the control shaft; and an elliptically shaped drive-side pinion gear meshed with the shaft-side pinion gear and turned by the drive motor, and the drive motor turns the drive-side pinion gear in accordance with an operating state of the engine and turns the control shaft via the shaft-side pinion gear to vary the compression ratio of the engine.

6. The multi-link variable compression ratio engine of claim 5, wherein the shaft-side pinion gear and the drive-side pinion gear are arranged so that a major axis of the shaft-side pinion gear and a minor axis of the drive-side pinion gear substantially coincide at an intermediate compression ratio of the engine.

7. The multi-link variable compression ratio engine of claim 1, wherein the linkage includes an upper link rotatably connected to the piston via a piston pin;

a lower link rotatably mounted on a crank pin of the crankshaft and rotatably connected to the upper link via an upper pin; and a control link rotatably connected at one end to the lower link via a control pin and rotatably connected at the other end to the eccentric axle of the control shaft.

8. The multi-link variable compression ratio engine of claim 7, wherein the reduction mechanism further includes an intermediate control link connected to the control shaft at a position offset from the rotational center axis of the control shaft; and a connecting link connected to the intermediate control link at one end of the connecting link and to the control shaft at another end of the connecting link, and the intermediate control link, the connecting link, and the actuator rod are arranged such that, at an intermediate compression ratio, a 180° angle is formed by the control shaft and the connecting link, a 90° angle is formed by the connecting link and the intermediate control link, and a 180° angle is formed by the intermediate control link and the actuator rod.

* * * * *